US006129594A

United States Patent [19]

Lai

[11] Patent Number: 6,129,594

[45] Date of Patent: Oct. 10, 2000

[54] ELECTRICAL CONNECTOR

[75] Inventor: Chin-Te Lai, Tao-Yuan, Taiwan

[73] Assignee: Hon Hai Precision Ind. Co., Ltd., Taipei Hsien, Taiwan

[21] Appl. No.: 09/444,025

[22] Filed: Nov. 19, 1999

[30] Foreign Application Priority Data

Apr. 6, 1999 [TW] Taiwan ..... 88205238

[51] Int. Cl.[7] ..... H01R 13/502

[52] U.S. Cl. ..... 439/701; 439/942; 439/596; 439/752

[58] Field of Search ..... 439/701, 942, 439/695, 724, 596, 752

[56] References Cited

U.S. PATENT DOCUMENTS 5,154,630 10/1992 Kamono et al. ..... 439/701

5,700,163 12/1997 Okabe ..... 439/701

6,039,611 3/2000 Yang ..... 439/701

*Primary Examiner*—Paula Bradley

*Assistant Examiner*—Tho D. Ta

*Attorney, Agent, or Firm*—Wei Te Chung

[57] ABSTRACT

An electrical connector includes an insulative housing, a shell, a plurality of terminals, a spacer and a pair of spacer covers. The insulative housing defines a plurality of passageways for receiving the terminals therein. The shell covers the housing for providing protection from EMI. The spacer is rearwardly assembled to the housing for properly positioning the terminals. The spacer cover engage, with the spacer and forms a space for receiving soldering sections of the terminal therein. Thus, the withstand voltage ability of the electrical connector is improved.

6 Claims, 5 Drawing Sheets

ELECTRICAL CONNECTOR

BACKGROUND OF THE INVENTION

The present invention relates to an electrical connector, and particularly to an electrical connector having a reliable engagement with a mating connector and withstand voltage capabilities between adjacent terminals of the electrical connector.

Taiwan Patent Application Nos. 82205124, 83107038, and 83200966 each disclose an electrical connector for engaging with a mating cable end connector having only one arranging element for positioning the mating connector. Commonly an insulative strip is needed for attaching to an end of the mating cable. In this way, the wires of the mating cable can be arranged in order. However, the assembly process is complicated.

Another conventional electrical connector disclosed in Taiwan Patent Application Nos. 81215103 and 85100751 has terminals outwardly extending to the mating direction without adequate arrangement. Thus, the terminals of the conventional connector can not be properly positioned. Therefore the withstand voltage ability of the electrical connector is weakened.

BRIEF SUMMARY OF THE INVENTION

A main object of the present invention is to provide an electrical connector having a spacer for properly positioning a plurality of terminals thereby improving the withstand voltage ability of the electrical connector.

To fulfill the above mentioned objects, an electrical connector in accordance with the present invention comprises an insulative housing, a shell, a plurality of terminals, a space and a pair of spacer covers. The insulative housing defines a plurality of passageways for receiving the terminals therein. The shell covers the housing for providing protection from EMI. The spacer is rearwardly assembled to the housing for properly positioning the terminals. The spacer cover engages with the spacer and forms a space for receiving soldering sections of the terminals.

Other objects, advantages and novel features of the invention will become more apparent from the following detailed description taken in conjunction with the accompanying drawings.

DETAILED DESCRIPTION OF THE INVENTION

Figure 1:
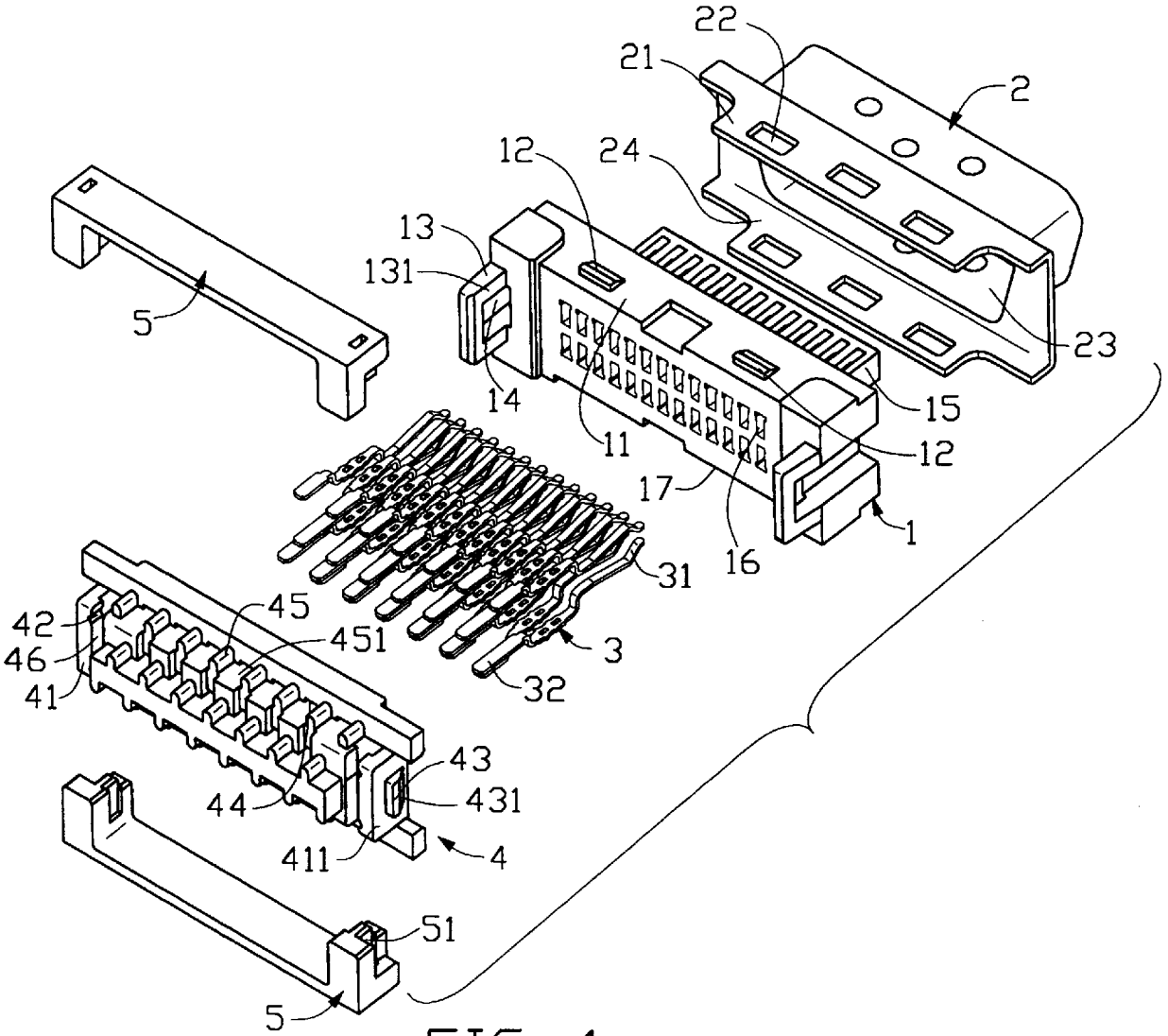
FIG. 1 is an exploded perspective view of an electrical connector in accordance with the present invention.

For facilitating understanding, like components are designated by like reference numerals through out the description of the various embodiments as shown in the attached drawing figures.

Referring to FIG. 1, an electrical cart connector comprises an insulative housing 1, a shell 2, a plurality of terminals 3, a spacer 4 and a pair of spacer covers 5. The insulative housing 1 defines a plurality of passageways 16 for receiving the terminals 3 therein. An extending portion 15 extends from the housing 1 for being received in a space 23 formed in the shell 2. A pair of ribs 12 is formed on a top surface 11 of the housing 1 for engaging with corresponding holes 22 of the shell 2. A pair of locking elements 13 extends from opposite ends of the housing 1 and an opening 14 is formed in each locking element 13.

The shell 2 covers the housing 1 for shielding the terminals 3 from EMI. Top and bottom extending plates 21, 24 formed by the shell 2 respectively cover the top surface 11 and a bottom surfaces 17 of the housing 1. Each terminal 3 has an contacting section 31 and a soldering section 32. The contacting section 31 is inserted into corresponding passageway 16 and extends into the extending portion 15 for contacting a mating connector (not shown). The spacer 4 is positioned between locking elements 13 which are formed on opposite ends of the housing 1. A plurality of receiving holes 44 are defined through the spacer 4 corresponding to the passageways 16 of the housing 1 for receiving the soldering sections 32 of the corresponding terminals 3 therein. Also the terminals 3 are received in the receiving holes 44 and are offset to each other. A plurality of bars 45 is equidistantly formed on the spacer 4 for forming the Positioning slots 451 and separating the soldering sections 32 of the terminals 3 from each other for improving the withstand voltage ability of the electrical connector. A pair of locking portions 41 is formed on opposite ends of the spacer 4. An outer surface 411 of each locking portion 41 engages with an inner surface 131 of the corresponding locking element 13 of the housing 1. A pair of projections 43 is formed on the outer surfaces 411 of the locking portions 41. An inner surface 46 of the each locking portion 41 defines a locking slot 42 therein. Each projection 43 has an inclined surface 431 for facilitating engagement between the projection 43 and the opening 14 of the corresponding locking element 13.

Figure 2:
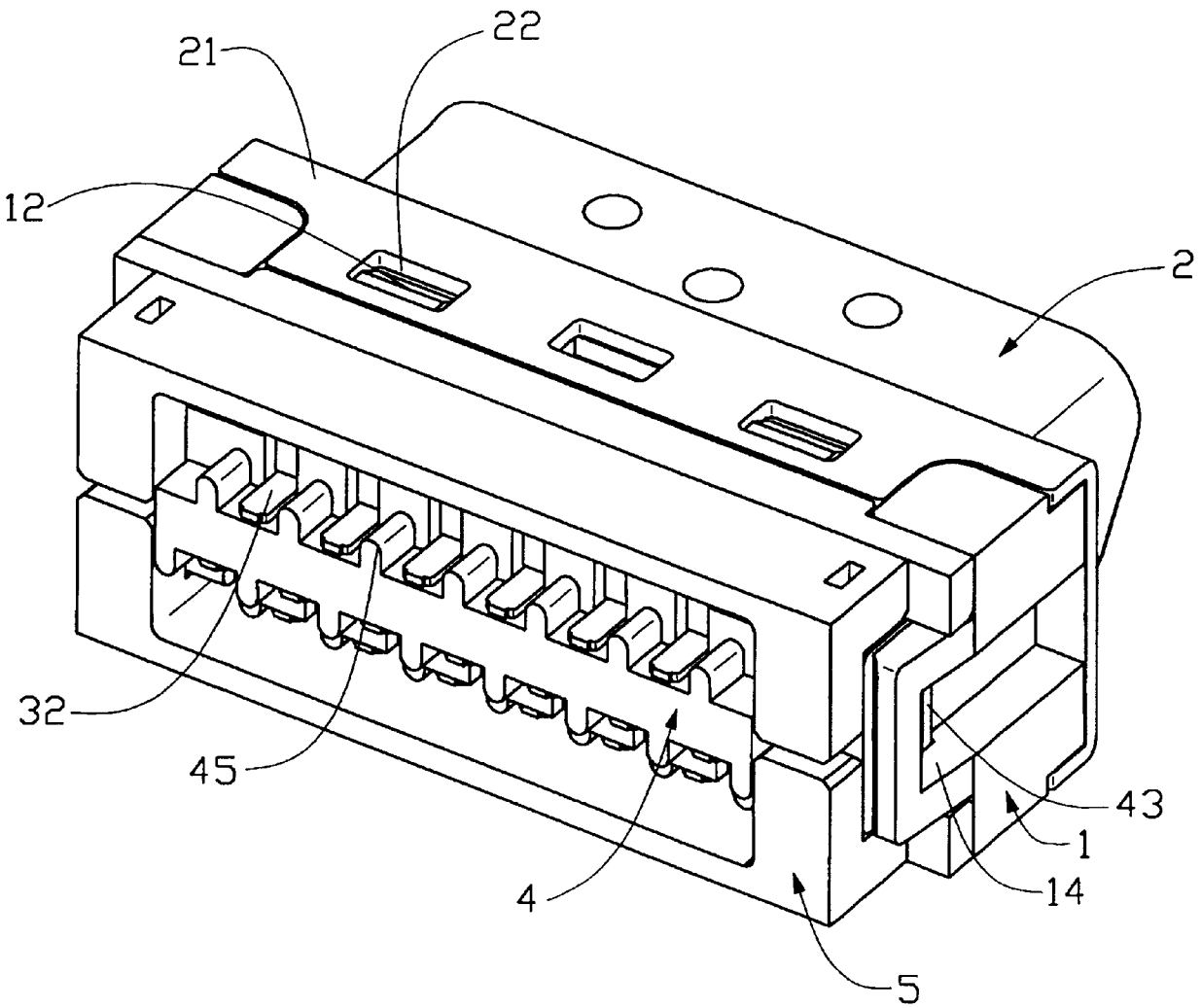
FIG. 2 is an assembled view of FIG. 1.
Figure 3:
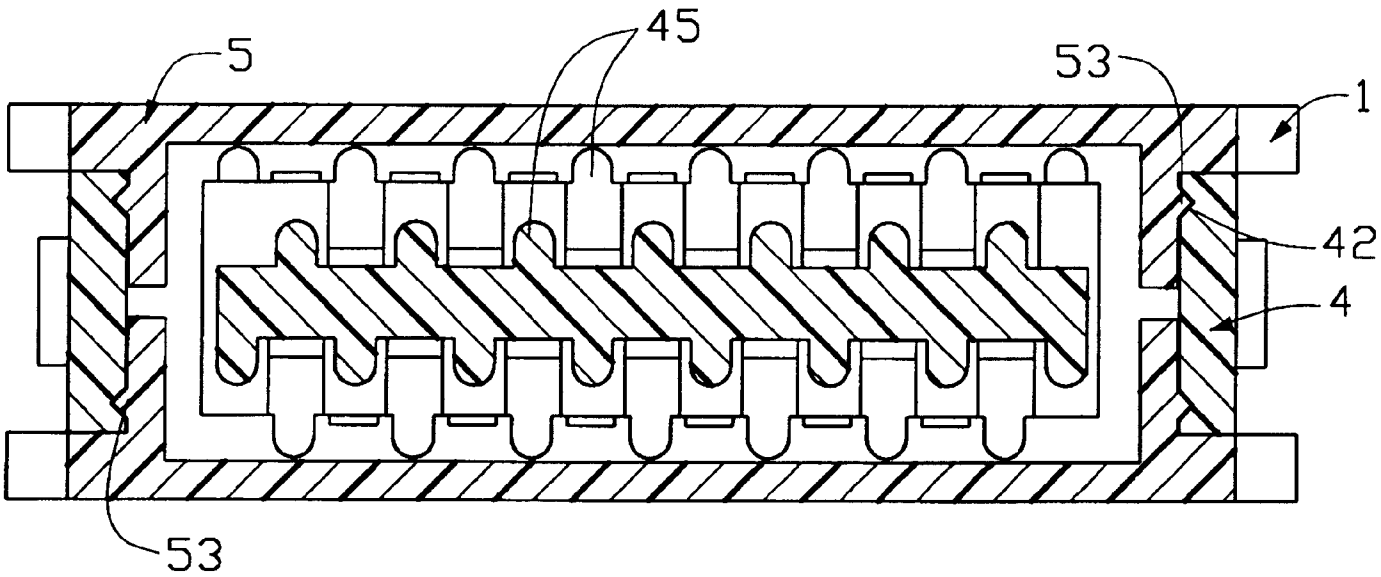
FIG. 3 is a cross sectional view of a spacer assembled with a pair of spacer covers.

Also referring to FIGS. 2 and 3, the spacer covers 5 engage with the spacer 4. A pair of engaging portions 51 is formed on opposite ends of each spacer cover 5 for engaging with the corresponding locking portions 41. A protrusion 53 is formed on each engaging portion 51 for engaging with the corresponding locking slot 42 of the spacer 4 for securing the spacer covers 5 to the spacer 4.

The ribs 12 of the housing 1 engage with the corresponding holes 22 of the shell 2 to secure the shell 2 to the housing 1. The protrusions 53 of the spacer covers 5 engage with the corresponding locking slots 42 of the spacer 4 for securely fixing the spacer cover 5 to the spacer 4. Thus, the soldering sections 32 of the terminals 3 are received in the receiving holes 44 of the spacer 4 for improving the withstand voltage ability of the electrical connector.

Figure 4A:
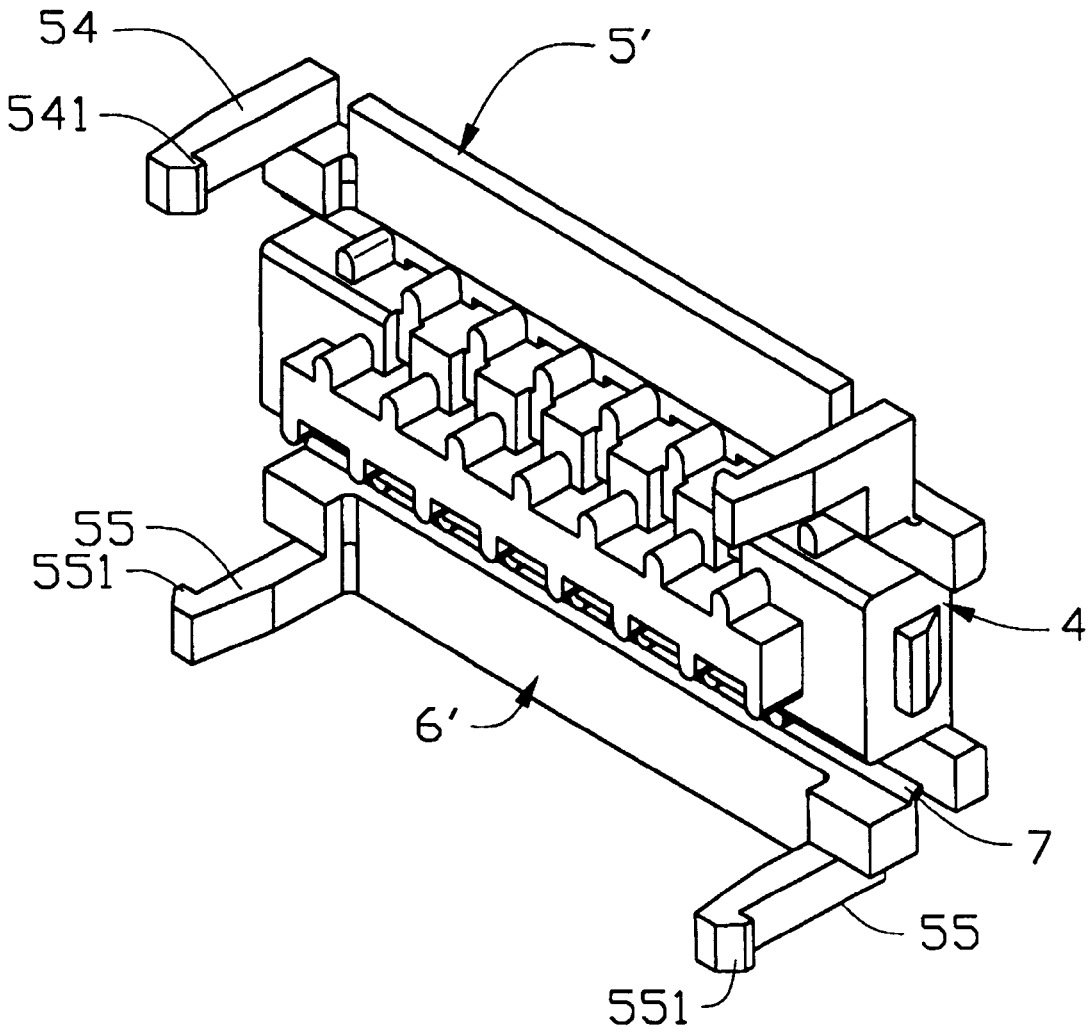
FIG. 4A is a perspective view of an alternative spacer of the present invention.
Figure 4B:
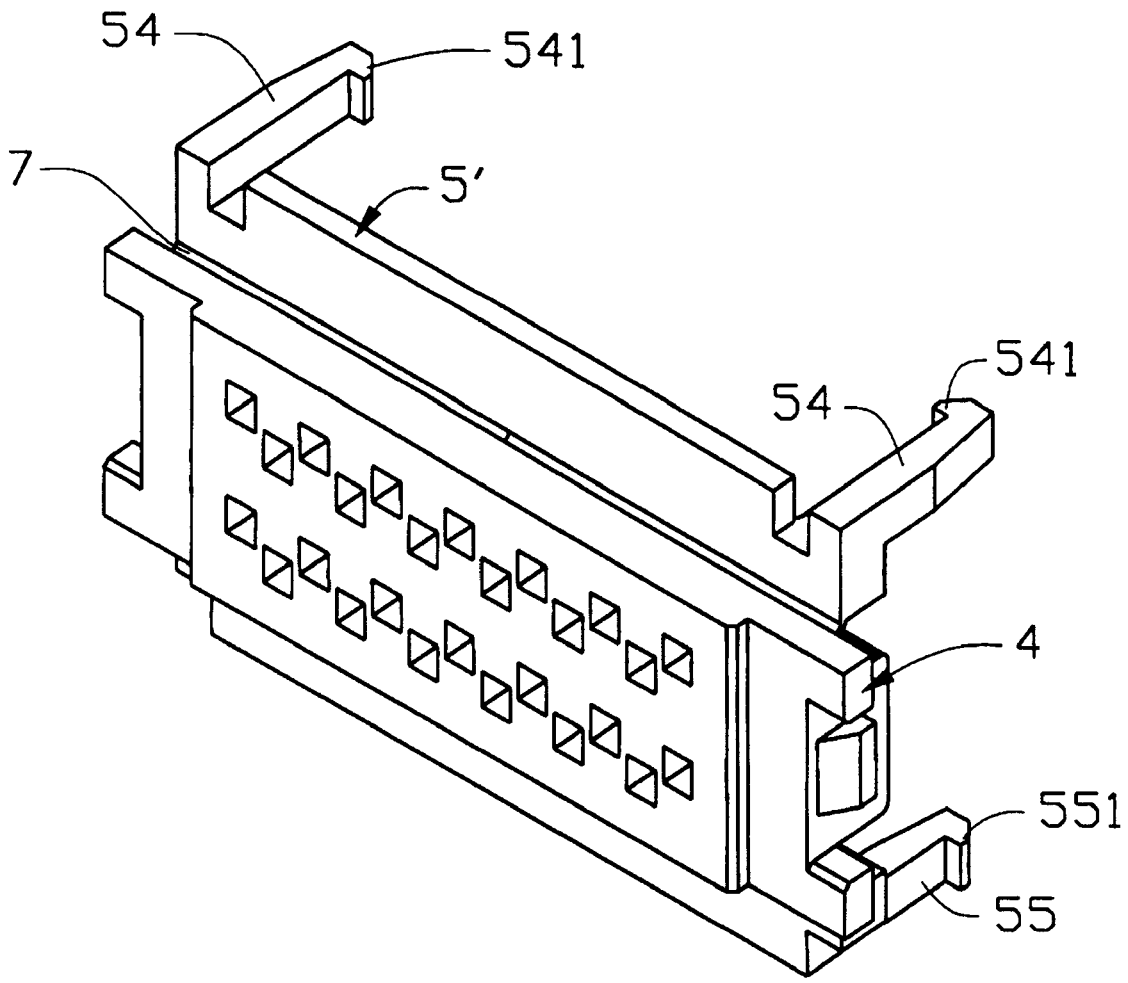
FIG. 4B is a rear side view of the alternative spacer.

FIGS. 4A and 4B illustrate another embodiment of a spacer cover 5' of the invention. An upper and a lower spacer cover 5', 6' connect with the spacer 4 through a thin plastic strip 7. A pair of engaging portions 54, 55 respectively extend from lateral ends of the spacer cover 5', 6', and a locking tip 541, 551 are formed at a fret end of each engaging arm 54, 55. After the terminals 3 are soldered with a circuit board (not shown), the upper and lower spacer cover 5', 6' pivot about the plastic strip 7. The locking tips 541 of the upper spacer cover 5' then lock with the locking tips 551 of the lower space cover 6' for defining a space around the soldering sections 32 of the terminals 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing forming a plurality of passageways, and a pair of locking elements extending from opposite ends thereof;

a plurality of terminals received in corresponding passageways, each terminal having a contacting section and a soldering section for termination of a corresponding wire of a cable;

a shell comprising a top and a bottom extending plates for respectively covering the housing;

a spacer being securely mounted to the insulative housing, the spacer having a plurality of bars equidistantly formed to define positioning slots to separate the soldering sections of the terminals from each other;

a pair of spacer covers attached to opposite sides of the spacer to shield the soldering sections of the terminals, a pair of engaging portions extending from lateral ends of each spacer cover;

a plurality of holes are formed in the top and bottom extending plates of the shell, and a plurality of ribs are formed on top and bottom surfaces of the housing for engaging with the holes; and a locking slot is formed in an inner side wall of the spacer and a protrusion is formed on a corresponding engaging portion of the spacer cover for engaging with the locking slot.

2. The electrical connector as claimed in claim 1, wherein the locking elements extend from opposite ends of the housing, each locking element defining an opening.

3. The electrical connector as claimed in claim 2, wherein a pair of projections is formed on the outer surface of the spacer, each projection having an inclined surface for facilitating engagement between the projection and the opening of the locking element.

4. The electrical connector as claimed in claim 1, wherein the positioning slots of the spacer are separated by said bars for properly positioning the soldering sections of the terminals.

5. The electrical connector as claimed in claim 4, wherein the terminals are offset and positioned in corresponding positioning slots.

6. An electrical connector comprising:

an insulative housing with a plurality of terminals therein, each of said terminals including a soldering section extending outwardly around a rear side of the housing for termination of a corresponding wire of the cable;

a spacer securely mounted on the rear side of the housing with a plurality of bars defining positioning slots each between the adjacent two bars to separate the soldering sections of the terminals from one another;

a pair of spacer covers positioned on opposite sides of the spacer and commonly defining a space to enclose said spacer therein; wherein the spacer covers are in a released condition for exposing the spacer and the soldering sections of the terminals thereon for easy soldering to the corresponding wires of the cable, while in a locking condition for reliably shielding the soldering sections and the corresponding wires which have seen soldered with each other; and each spacer cover pivotally connects with the spacer through a thin plastic strip, each spacer cover having a pair of engaging portions extends from lateral ends thereof, and a locking tip is formed at a free end of each engaging portion, wherein the locking tips of one of said pair of spacer covers lock with the locking tips of the other of said pair of spacer covers in said locking condition for defining said space.

* * * * *